US010272689B2

(12) United States Patent
Benson et al.

(10) Patent No.: US 10,272,689 B2
(45) Date of Patent: Apr. 30, 2019

(54) INK SUPPLIES

(71) Applicant: Hewlett-Packard Development Company, L.P., Houston, TX (US)

(72) Inventors: Brad Benson, Corvallis, OR (US); David Olsen, Corvallis, OR (US); Mike M. Morrow, Corvallis, OR (US); Patrick V. Boyd, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/747,702

(22) PCT Filed: Jul. 30, 2015

(86) PCT No.: PCT/US2015/042985
§ 371 (c)(1),
(2) Date: Jan. 25, 2018

(87) PCT Pub. No.: WO2017/019101
PCT Pub. Date: Feb. 2, 2017

(65) Prior Publication Data

US 2018/0215162 A1 Aug. 2, 2018

(51) Int. Cl.
*B41J 2/175* (2006.01)
*B41J 29/393* (2006.01)

(52) U.S. Cl.
CPC ..... *B41J 2/17556* (2013.01); *B41J 2/175* (2013.01); *B41J 2/17513* (2013.01); *B41J 2/17566* (2013.01); *B41J 2/17596* (2013.01); *B41J 29/393* (2013.01); *B41J 2002/17516* (2013.01)

(58) Field of Classification Search
CPC .. B41J 2/17556; B41J 2/17566; B41J 29/393; B41J 2/175; B41J 2/17513; B41J 2/17596; B41J 2002/17516
See application file for complete search history.

(56) References Cited

U.S. PATENT DOCUMENTS

| | | | |
|---|---|---|---|
| 5,489,932 | A | 2/1996 | Ceschin et al. |
| 5,847,734 | A | 12/1998 | Pawlowski, Jr. |
| 6,575,567 | B2 | 6/2003 | Matsumoto et al. |
| 6,739,712 | B2 | 5/2004 | Kim |

(Continued)

FOREIGN PATENT DOCUMENTS

| | | |
|---|---|---|
| WO | 2017019101 | 2/2017 |

OTHER PUBLICATIONS ip.com search (Year: 2018).*

(Continued)

*Primary Examiner* — Lisa Solomon
(74) *Attorney, Agent, or Firm* — Hanley Flight & Zimmerman LLC

(57) ABSTRACT

Ink supplies are disclosed in examples herein. An example apparatus a housing includes a first chamber and a second chamber, the housing defining a first port to fluidly couple the first chamber to a printer, the housing including a second port to fluidly couple the first chamber and the second chamber to flow fluid from the second chamber to the first chamber. The apparatus also includes a regulator coupled between the first chamber and the second chamber, the regulator to flow gas from the first chamber to the second chamber when a pressure within the first chamber reaches a threshold.

16 Claims, 15 Drawing Sheets

(56) References Cited

U.S. PATENT DOCUMENTS

| | | | |
|---|---|---|---|
| 7,475,972 | B2 | 1/2009 | Qingguo et al. |
| 8,132,898 | B2 | 3/2012 | Fukazawa et al. |
| 8,376,487 | B2 | 2/2013 | Murray |
| 8,465,136 | B2 | 6/2013 | Yuen |
| 8,668,319 | B2 | 3/2014 | Gonzales et al. |
| 8,807,718 | B2 | 8/2014 | Murray |
| 8,882,247 | B2 | 11/2014 | Borra et al. |
| 2002/0105564 | A1 | 8/2002 | Matsumoto et al. |
| 2003/0122907 | A1 | 7/2003 | Kim |
| 2008/0165232 | A1 | 7/2008 | Yuen |
| 2013/0194354 | A1 | 8/2013 | Petruchik et al. |
| 2013/0271534 | A1 | 10/2013 | Boyd et al. |
| 2013/0335493 | A1 | 12/2013 | Gonzales et al. |
| 2014/0146112 | A1 | 5/2014 | Murray |

OTHER PUBLICATIONS

International Searching Authority, "International Search Report," Issued in connection with International Application No. PCT/US2015/042985 dated Apr. 8, 2016, 3 pages.

International Searching Authority, "Written Opinion," issued in connection with International Application No. PCT/US2015/042985 dated Apr. 8, 2016, 9 pages.

* cited by examiner

INK SUPPLIES

BACKGROUND

Inkjet printing devices include a printhead having a number of nozzles. The nozzles are used to eject fluid (e.g., ink) onto a substrate to form an image. Some inkjet printing devices include a stationary printbar that includes a printhead.

BRIEF DESCRIPTION OF THE DRAWINGS

The figures are not to scale. Wherever possible, the same reference numbers will be used throughout the drawing(s) and accompanying written description to refer to the same or like parts.

DETAILED DESCRIPTION

Figure 1:
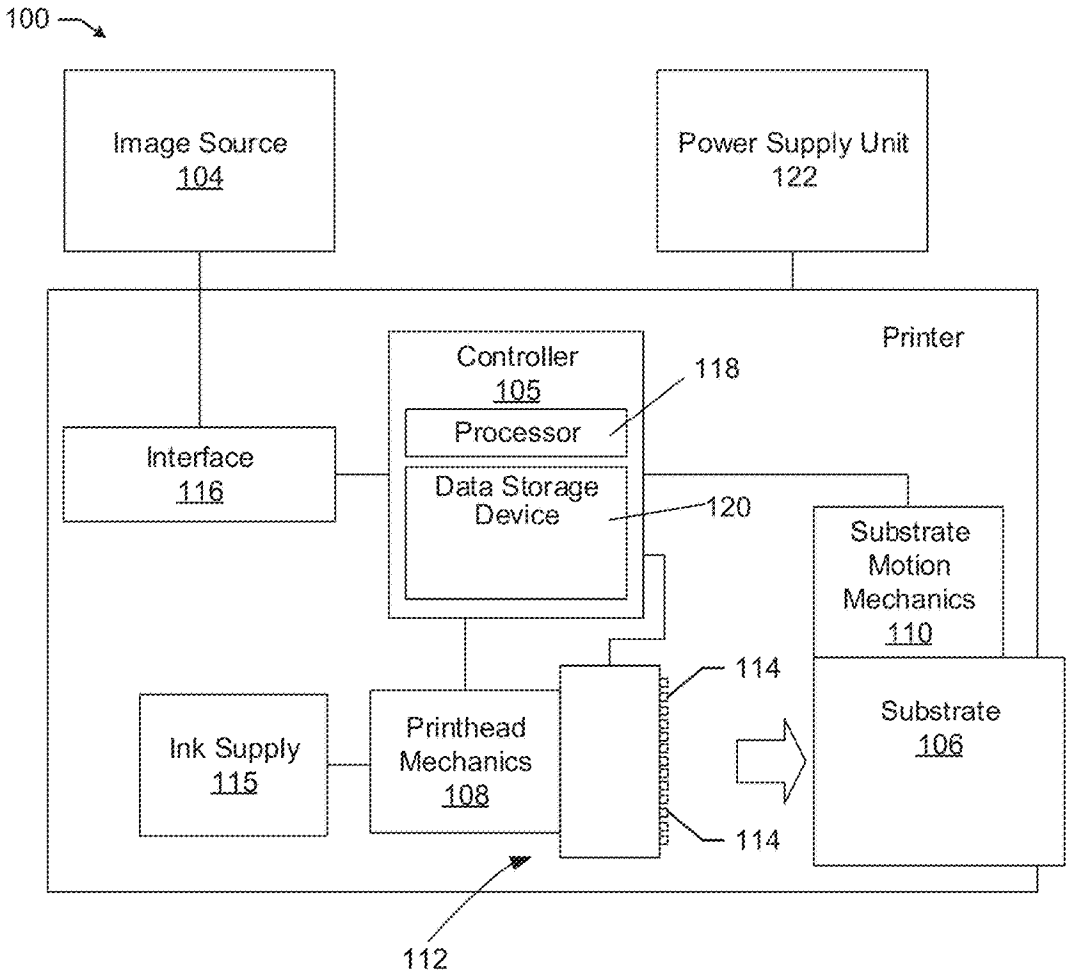
FIG. 1 is a schematic illustration of an example printer that can be used to implement the examples disclosed herein.

The examples disclosed herein relate to multi-chamber ink supplies for use with printers (e.g., imaging devices, multifunction printers, etc.). In some examples, an example multi-chamber ink supply includes a first and/or regulated chamber and a second and/or free-ink chamber. The regulated chamber may be fluidically (fluidly) coupled to the free-ink chamber to facilitate (e.g., enable) ink to be supplied from the free-ink chamber to the regulated chamber. In some examples, the regulated chamber is sized and/or pressure regulated to facilitate ink within the regulated chamber to be provided to a printer to which the ink supply is coupled in a controlled and/or regulated manner.

During a printing operation, in some examples, the printer draws ink from the regulated chamber and the regulated chamber in turn draws ink from the free-ink chamber. In some examples, to displace ink that is extracted from the free-ink chamber, ambient air is drawn through a regulator into the free-ink chamber. In some instances, air enters the printer and/or the ink supply when, for example, an ink supply freezes and/or thaws, when an ink supply is replaced and/or when an ink level within the printer is below a threshold. Air within the printing device and/or the ink supply may impede the flow of ink from the ink supply and/or into the printer.

To remove air from the printer, in some examples, the printer may cause the ink supply to undergo a maintenance operation that creates a negative pressure and/or a backpressure within the regulated chamber. In some examples, during the maintenance operation, a spring biased airbag and/or bladder is inflated to urge ink from the regulated chamber into the printer. To create a negative pressure and/or backpressure within the regulated chamber, the airbag is quickly deflated to draw air into the regulated chamber from the printer. In some examples, air that is drawn from the printer into the regulated chamber is trapped in the regulated chamber. The air trapped in the regulated chamber may consume space (e.g., all of the space) and restrict the ability of the spring biased airbag to urge ink into the printer and/or draw air from the printer.

To decrease the pressure in the regulated chamber when the pressure reaches a threshold, the example multi-chamber ink supplies disclosed herein include a purge valve and/or regulator coupled between the regulated chamber and the free-ink chamber. In some examples, to urge air out of the regulated chamber, the spring biased airbag is inflated to purposefully increase the pressure within the regulated chamber above the threshold to cause the regulator to actuate to facilitate air to vent from the regulated chamber, through the regulator and into the free-ink chamber. Venting air from the regulated chamber decreases the pressure within the regulated chamber.

In some examples, the regulator is implemented by an umbrella valve. In some such examples, the umbrella valve includes a stem and a membrane and/or plug. To secure the umbrella valve within the multi-chamber ink supply, in some examples, the stem includes a protrusion (e.g., an annular protrusion, a flange) positioned on a first side of an aperture and the plug of the umbrella valve is positioned on a second side of the aperture.

In operation, in some examples, when the pressure within the regulated chamber increases above the threshold, a pressure force of the fluid within the regulated chamber overcomes the biasing force of the plug. When the pressure force is higher than the biasing force, the plug may be urged away from a valve seat to facilitate fluid to pass from the regulated chamber about the sides of the plug to the free-ink chamber to reduce the pressure within the regulated chamber. Thus, when the umbrella valve is actuated, the pressure within the regulated chamber may be reduced. When the pressure within the regulated chamber decreases below the threshold, in some examples, the biasing force of the plug is greater than the pressure force in the regulated chamber and the plug reengages the valve seat to substantially prevent further fluid flow from the regulated chamber to the free-ink chamber. As set forth herein, substantially prevent further fluid flow means that the fluid flow is reduced and/or discouraged by the interaction between the seat and the valve seat and/or the fluid flow is stopped by the interaction between the seat and the valve seat.

In some examples, the example regulator is implemented by an example one-way valve that includes a flowline that extends from the regulated chamber into the free-ink chamber. In some such examples, a first end of the flowline is disposed above an ink level within the regulated chamber and a second end of the flowline is disposed below an ink level within the free-ink chamber.

In operation, in some examples, when the pressure within the regulated chamber increases above the threshold, a pressure force of the air within the regulated chamber overcomes the fluid force of the ink at the second end of the flowline. When the pressure force overcomes the fluid force, air flows from the regulated chamber to the free-ink chamber to reduce the pressure within the regulated chamber. When the pressure within the regulated chamber decreases below the threshold, in some examples, the fluid force is greater than the pressure force, thereby substantially preventing further fluid flow between the regulated chamber and the free-ink chamber.

FIG. 1 is a block diagram of an example printer 100 that can be used to implement the teachings of this disclosure. The example printer 100 of FIG. 1 includes an example image source 104 and an example substrate 106 (e.g., paper). The image source 104 may be a computing device from which the printer 100 receives data describing a print job to be executed by an example controller 105 of the printer 100 to print an image on the substrate 106.

In the example of FIG. 1, the printer 100 also includes example printhead mechanics 108 and example substrate motion mechanics 110. In some examples, the example printhead mechanics 108 and/or the substrate motion mechanics 110 include mechanical devices that move a printhead 112 having a plurality of nozzles 114 and/or the substrate 106, respectively, when printing an image on the substrate 106. According to the illustrated example, instructions to move the printhead 112 and/or the substrate 106 are received and processed by the example controller 105 (e.g., from the image source 104). In some examples, signals may be sent to the printhead 112 and/or the substrate motion mechanics 110 from the controller 105. In examples in which the printer 100 is implemented as a page-wide array printer, the printhead 112 may be stationary and, thus, the printer 100 may not include the printhead mechanics 108 or the printhead mechanics 108 may not be utilized. In this example, a fluid reservoir and/or ink supply 115 is fluidically coupled to the printhead 112. In some examples, the ink supply 115 includes more than one ink cartridge and/or supply. During a printing operation, the ink supply 115 provides ink to the printhead 112 to image the substrate 106.

The example printer 100 of FIG. 1 includes an interface 116 to interface with the image source 104. The interface 116 may be a wired or wireless connection connecting the printer 100 and the image source 104. The image source 104 may be a computing device from which the printer 100 receives data describing a print job to be executed by the controller 105. In some examples, the interface 116 facilitates the printer 100 and/or a processor 118 to interface with various hardware elements, such as the image source 104 and/or hardware elements that are external and/or internal to the printer 100. In some examples, the interface 116 interfaces with an input or output device, such as, for example, a display device, a mouse, a keyboard, etc. The interface 116 may also provide access to other external devices such as an external storage device, network devices, such as, for example, servers, switches, routers, client devices, other types of computing devices and/or combinations thereof.

The example controller 105 includes the example processor 118, including hardware architecture, to retrieve and execute executable code from an example data storage device 120. The executable code may, when executed by the example processor 118, cause the processor 118 to implement at least the functionality of controlling the printhead 112 to print on the example substrate 106 and/or actuate the printhead and/or substrate motion mechanics 108, 110. The executable code may, when executed by the example processor 118, cause the processor 118 to provide instructions to a power supply unit 122, to cause the power supply unit 122 to provide power to the example printhead 112 to eject a fluid from the example nozzle(s) 114.

The data storage device 120 of FIG. 1 stores instructions that are executed by the example processor 118 or other processing devices. The example data storage device 120 may store computer code representing a number of applications, firmware, machine readable instructions, etc. that the example processor 118 executes to implement the examples disclosed herein.

While an example manner of implementing the printer is illustrated in FIG. 1, in some examples, at least one of the elements, processes and/or devices illustrated in FIG. 1 may be combined, divided, re-arranged, omitted, eliminated and/or implemented in any other way. Further, the example image source 104, the example controller 105, the example substrate 106, the example printhead mechanics 108, the example substrate motion mechanics 110, the example printhead 112, the example nozzles 114, the example interface 116, the example processor 118, the example data storage device 120, the example power supply unit 122 and/or, more generally, the example printer 100 of FIG. 1 may be implemented by hardware, software, firmware and/or any combination of hardware, software and/or firmware. Thus, for example, any of the example image source 104, the example controller 105, the example substrate 106, the example printhead mechanics 108, the example substrate motion mechanics 110, the example printhead 112, the example nozzles 114, the example interface 116, the example processor 118, the example data storage device 120, the example power supply unit 122 and/or, more generally, the example printer 100 could be implemented by a circuit(s), a programmable processor(s), an application specific integrated circuit(s) (ASIC(s)), a programmable logic device(s) (PLD(s)) and/or a field programmable logic device(s) (FPLD(s)), etc.

When reading any of the apparatus or system claims of this patent to cover a purely software and/or firmware implementation, at least one of the example image source 104, the example controller 105, the example substrate 106, the example printhead mechanics 108, the example substrate motion mechanics 110, the example printhead 112, the example nozzles 114, the example interface 116, the example processor 118, the example data storage device 120, the example power supply unit 122 is hereby expressly defined to include a tangible computer readable storage device or storage disc such as a memory, DVD, CD, Blu-ray, etc. storing the software and/or firmware. Further still, the example printer 100 of FIG. 1 may include an element(s), process(es) and/or devices in addition to, or instead of, those illustrated and/or may include more than one of any or all of the illustrated elements, processes and devices.

Figure 2:
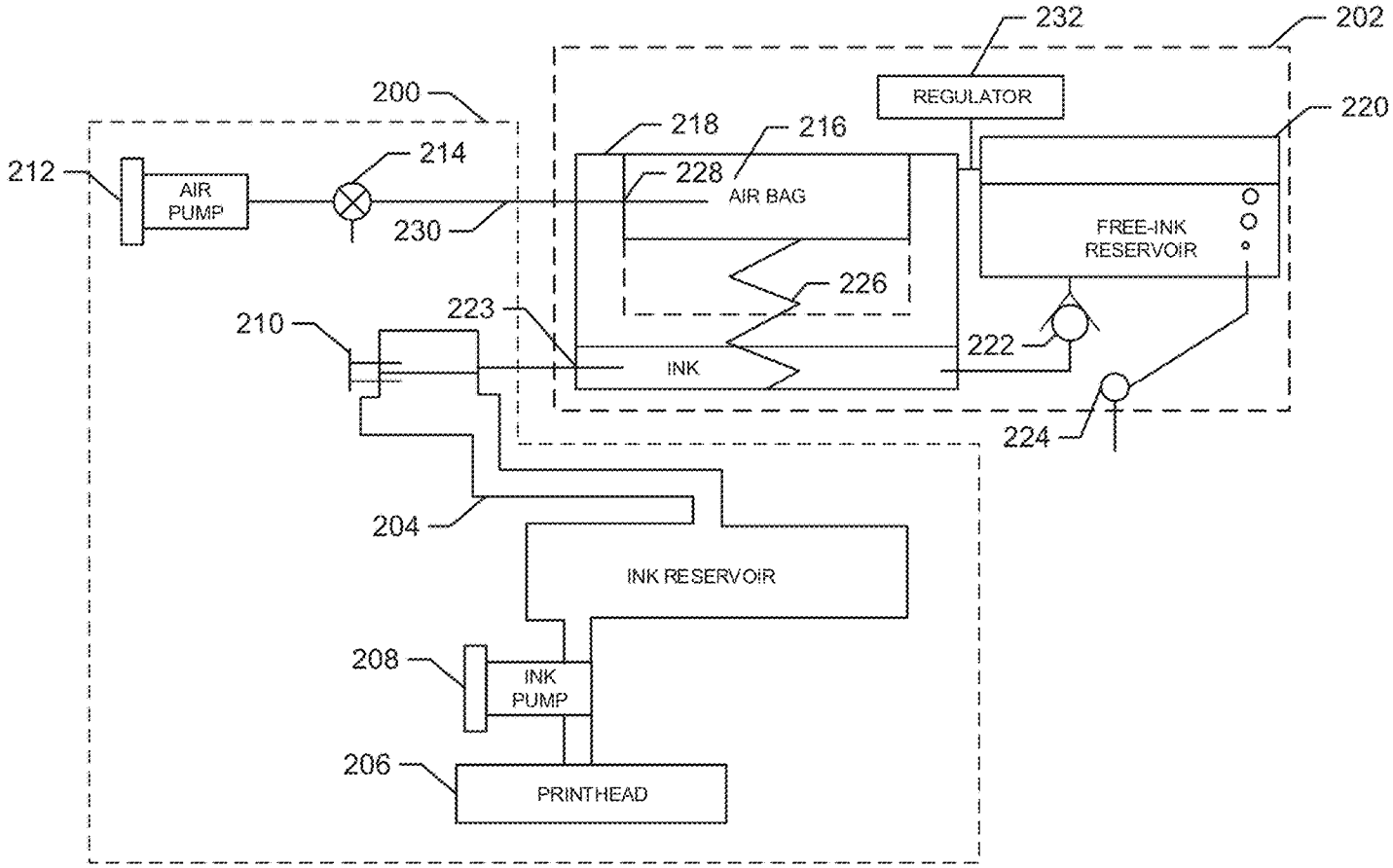
FIG. 2 is a schematic illustration of a portion of an example printer and an example ink supply that can be used to implement the example printer of FIG. 1.

FIG. 2 illustrates an example printer 200 to which an example ink supply 202 is coupled. In some examples, the printer 200 can be used to implement the printer 100 of FIG. 1 and the example ink supply 202 can be used to implement the example ink supply 115 of FIG. 1. In this example, the printer 200 includes a reservoir 204 that is coupled to the ink supply 202. To draw fluid toward a printhead 206 of the printer 200, in this example, the printer 200 includes an ink pump 208. In the illustrated example, to monitor a level of ink within the reservoir 204, the printer 200 includes a sensor(s) 210. In this example, the printer 200 includes an air pump 212 coupled to a valve 214. In some examples, the valve 214 is a three-way valve that is actuatable to fluidically couple an airbag and/or bladder 216 of the ink supply 202 to the air pump 212 or to fluidically couple the airbag 216 to atmospheric pressure.

In this example, the ink supply 202 is a multi-chamber ink supply including a first and/or a regulated chamber 218 and a second and/or free-ink chamber 220. In the illustrated example, the regulated chamber 218 is fluidically coupled to the free-ink chamber 220 to facilitate ink to be supplied from the free-ink chamber 220 to the regulated chamber 218. To restrict and/or control the flow of fluid between the regulated chamber 218 and the free-ink chamber 220, in this example, a first regulator and/or check valve 222 is disposed between the regulated chamber 218 and the free-ink chamber 220.

During a printing operation, in some examples, the printer 200 draws ink from the regulated chamber 218 through a port 223 of the ink supply 202 and the regulated chamber 218 in turn draws ink from the free-ink chamber 220. To displace ink that is drawn from the free-ink chamber 220, in this example, ambient air is drawn through a second regulator 224 into the free-ink chamber 220.

If the printer 200 determines that a level of ink within the reservoir 204 is below a threshold based on, for example, data obtained from the sensor 210, the printer 200 may cause the ink supply 202 to perform a maintenance operation. In some examples, the maintenance operation includes urging ink from the ink supply 202 into the reservoir 204 of the printer 200 and/or removing air from the printer 200.

In some examples, to urge ink into the printer 200, the printer 200 actuates the valve 214 to fluidically couple the air pump 212 and the airbag 216 to facilitate the airbag 216 to be inflated by the air pump 212 against a biasing force of a spring 226. In some examples, the airbag 216 includes a port 228 that is fluidically coupled to the valve 214 and/or the air pump 212 via a flowline 230. In this example, inflating the airbag 216 increases the pressure within the regulated chamber 218, substantially allows the closure of the first regulator 222 to discourage fluid flow from the regulated chamber 218 to the free-ink chamber 220 through the first regulator 222 and urges ink remaining within the regulated chamber 218 into the reservoir 204. In the illustrated example, to remove air from the printer 200, the printer 200 actuates the valve 214 to fluidically couple the airbag 216 to atmosphere to facilitate the spring 226 to quickly collapse the airbag 216 and draw air from the reservoir 204 into the regulated chamber 218.

In the illustrated example, to remove air captured within the regulated chamber 218 and/or to reduce the pressure of the regulated chamber 218, the example ink supply 202 includes a purge valve and/or a third regulator 232 coupled between the regulated chamber 218 and the free-ink chamber 220. In some examples, the third regulator 232 is an umbrella valve that is configured to actuate when the pressure within the regulated chamber 218 is above a threshold. In some such examples, when the umbrella valve actuates, pressure is released from the regulated chamber 218 to the free-ink chamber 220. In other examples, the third regulator 232 is a one-way valve having a flowline that extends below a fluid level within the free-ink reservoir 220. In some such examples, when the pressure force within the regulated chamber 218 overcomes the fluid force within the free-ink reservoir 220, pressure is released from the regulated chamber 218 to the free-ink chamber 220. In other examples, the third regulator 232 is an aperture that facilitates fluid to flow from the regulated chamber 218 to the free-ink reservoir 220 and/or deters the flow of fluid from the regulated chamber 218 to the free-ink reservoir 220.

Figure 3:
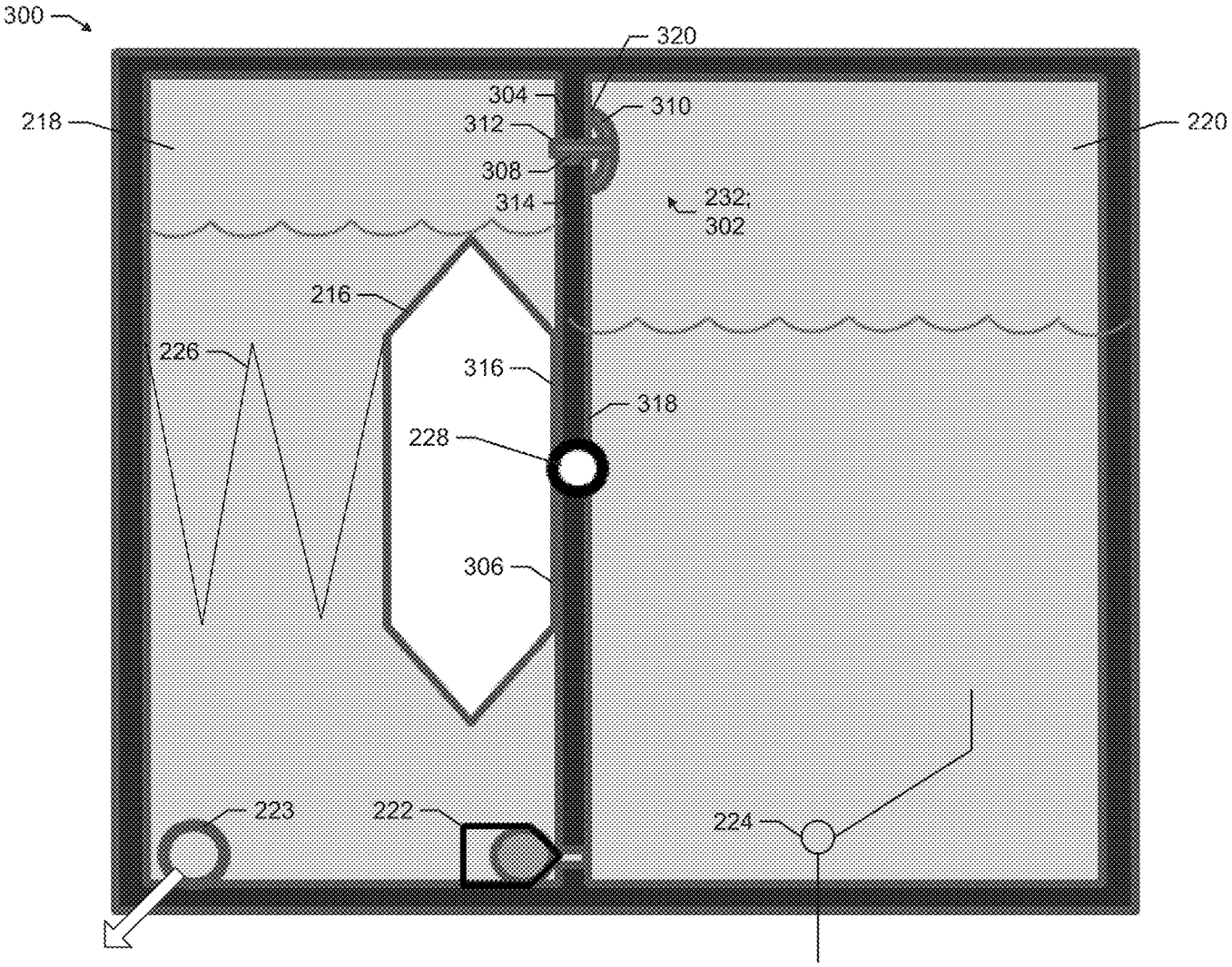
FIGS. 3, 4 and 5 are schematic illustrations of an example ink supply that can be used to implement the example ink supply of FIG. 2 and/or the example printer of FIG. 1.
Figure 4:
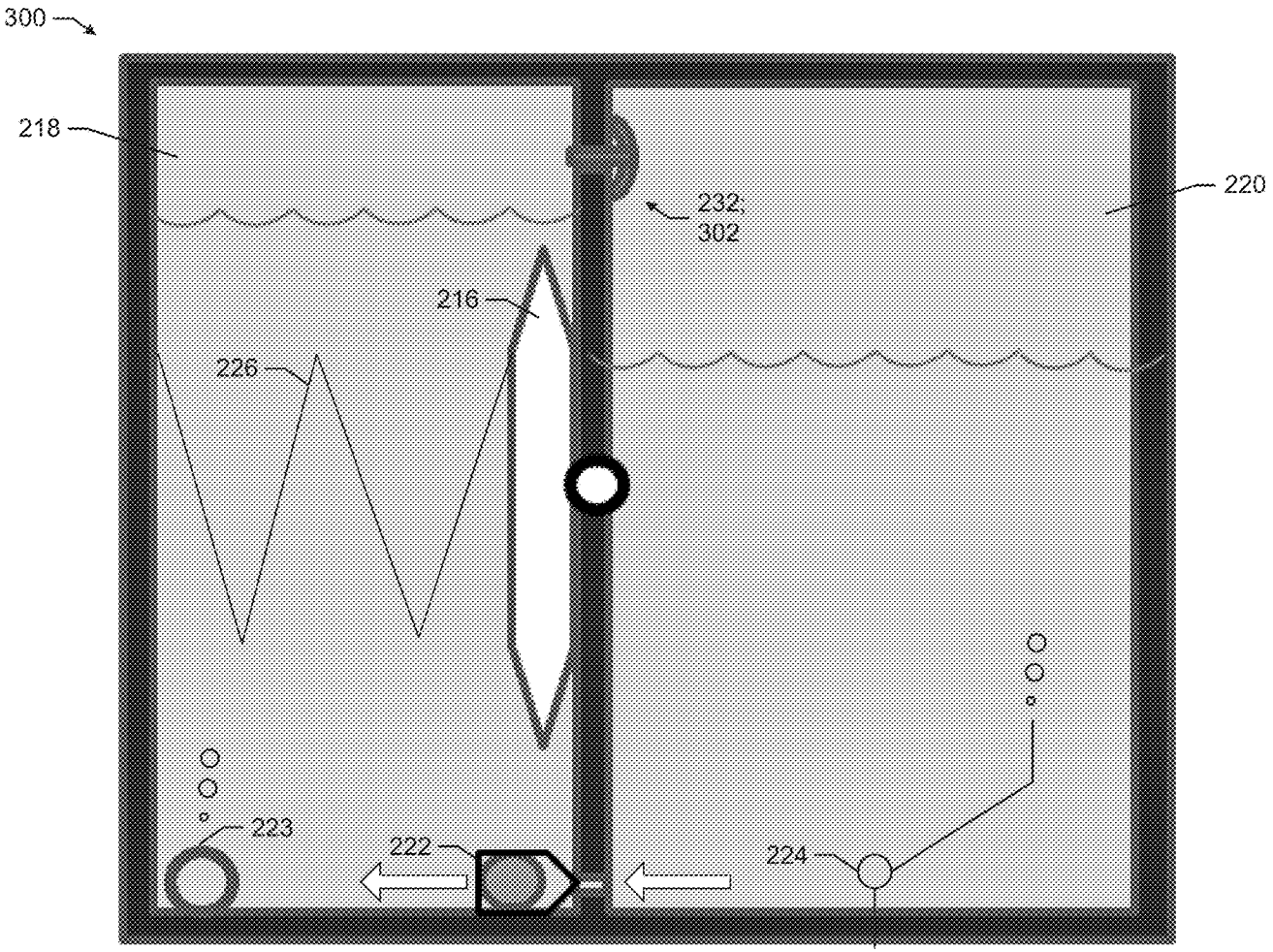
Figure 5:
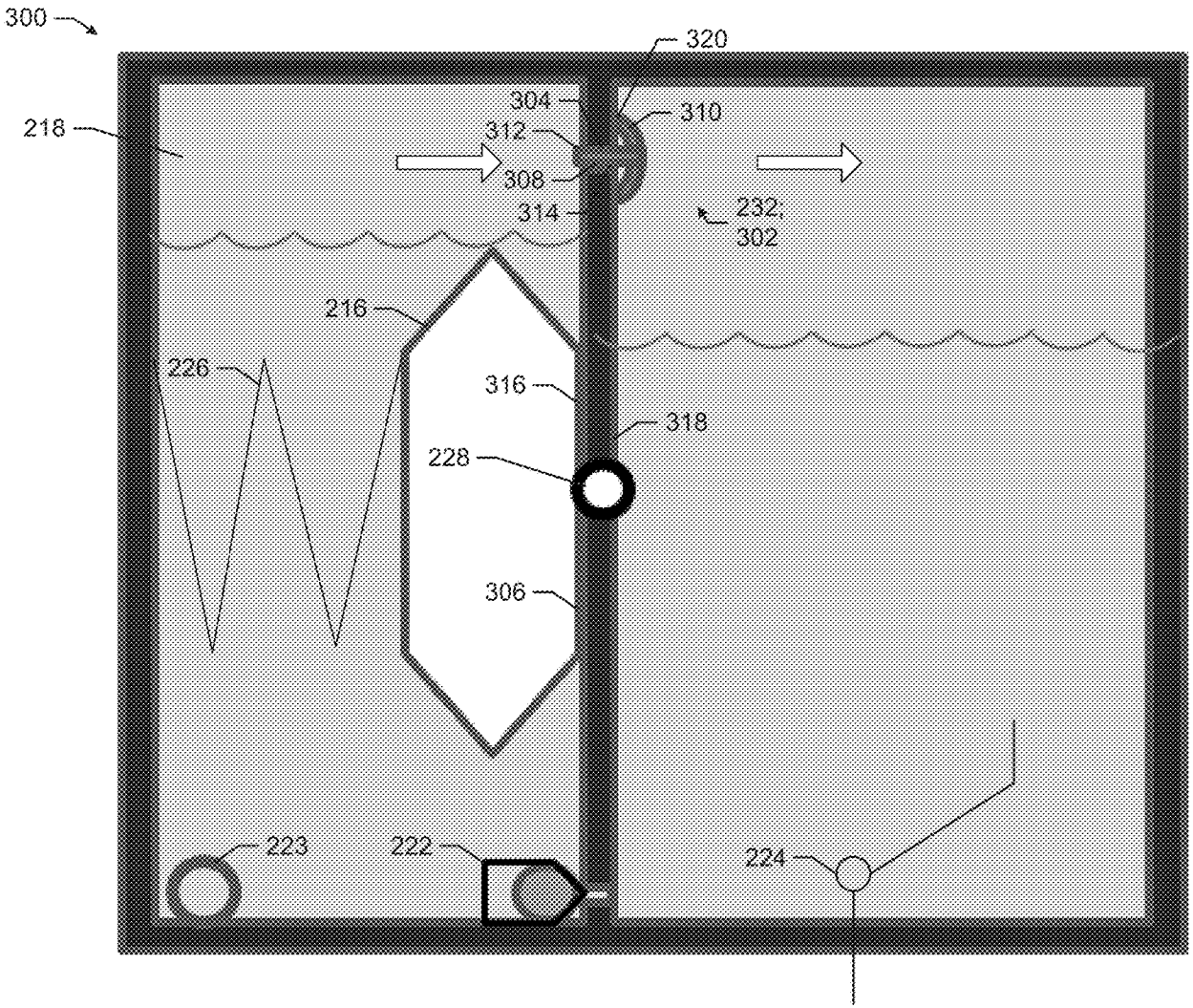
Figure 6:
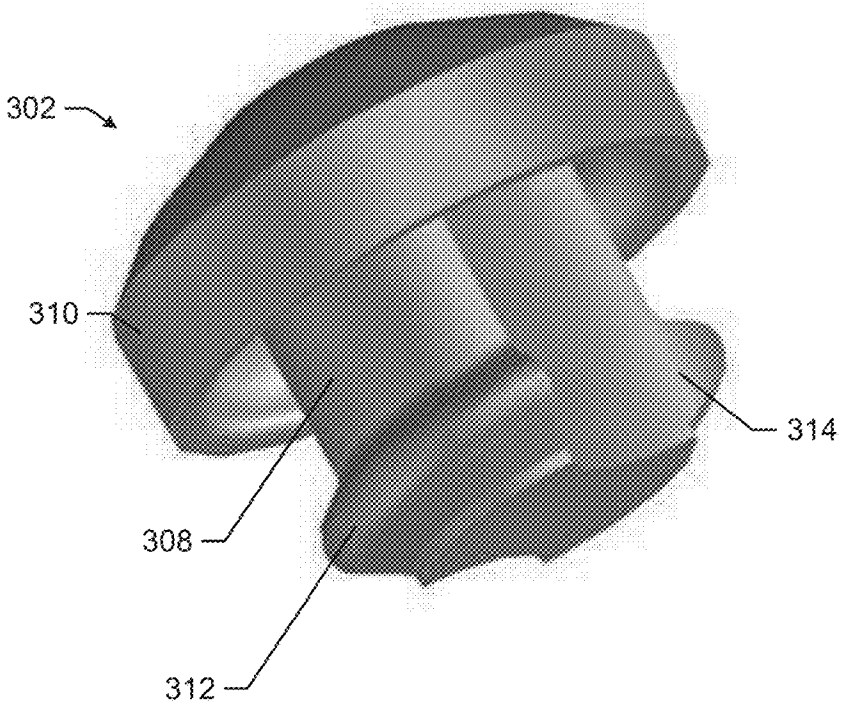
FIG. 6 is an example fluid control device that can be used to implement the example ink supply of FIGS. 2, 3, 4 and/or 5.

FIGS. 3, 4 and 5 illustrate an example ink supply 300 that can be used to implement the example ink supply 115, 202 of FIGS. 1 and/or 2. In this example, the regulator 232 is implemented as an example umbrella valve 302 that extends through an aperture 304 defined by a wall 306 that separates the regulated chamber 218 and the free-ink chamber 220. In the illustrated example, and as best shown in FIG. 6, the umbrella valve 302 includes a stem 308 and a membrane and/or plug 310. In this example, the stem 308 includes a protrusion 312 and a flow channel(s) 314. As shown in the examples of FIGS. 3-5, to secure the umbrella valve 302 relative to the aperture 304, the protrusion 312 engages a first side 316 of the wall 306 and the plug 310 engages a second side 318 of the wall 306.

As shown in FIG. 3, in some examples, to urge ink into the printer 200, the airbag 216 is inflated by the air pump 212 against a biasing force of a spring 226 to urge ink out of the regulator chamber 218 through the port 223. As shown in FIG. 4, in some examples, to draw air out of the printer 200, the airbag 216 is quickly deflated to draw air from the printer 200 into the regulated chamber 218 through the port 223.

As shown in FIG, 5, in some examples, when the pressure within the regulated chamber 218 increases above the threshold, a maintenance operation can be performed in which the airbag 216 is inflated against the spring force of the spring 226 and the first regulator 222 is in a closed position due to, for example, the increased pressure within the regulated chamber 218. When the pressure force is higher than a biasing force of the plug 310, the plug 310 is urged away from a valve seat 320 to facilitate air to vent from the regulated chamber 218 through the flow channel 314 to the free-ink chamber 220. When air is vented from the regulated chamber 218, the pressure within the regulated chamber 218 decreases.

As shown in FIG. 4, when the pressure within the regulated chamber 218 decreases below the threshold, the biasing force of the plug 310 is greater than the pressure force in the regulated chamber 218. In some examples, the pressure in the regulated chamber 218 decreases when the airbag 216 is quickly deflated by the spring 226 after the valve 214 places the airbag 216 in fluid communication with ambient air. When the biasing force of the umbrella valve 302 is greater than the pressure force, the plug 310 moves to reengage the valve seat 320 and the first regulator 222 opens to facilitate ink to flow from the free-ink chamber 220 through the first regulator 222 and into the regulated chamber 218.

Figure 7:
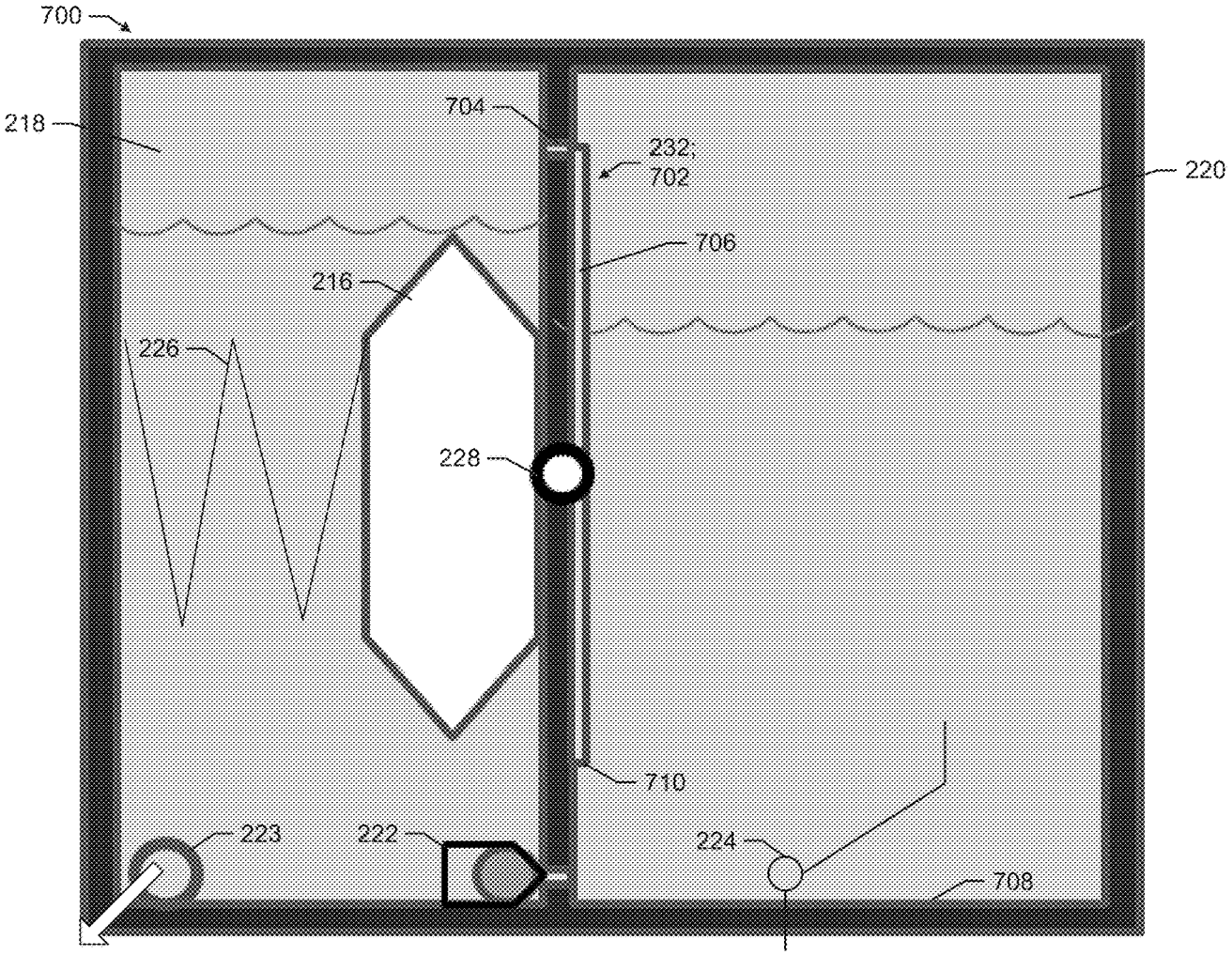
FIGS. 7, 8 and 9 are schematic illustrations of an example second example ink supply that can be used to implement the example ink supply of FIG. 2 and/or the example printer of FIG. 1.
Figure 8:
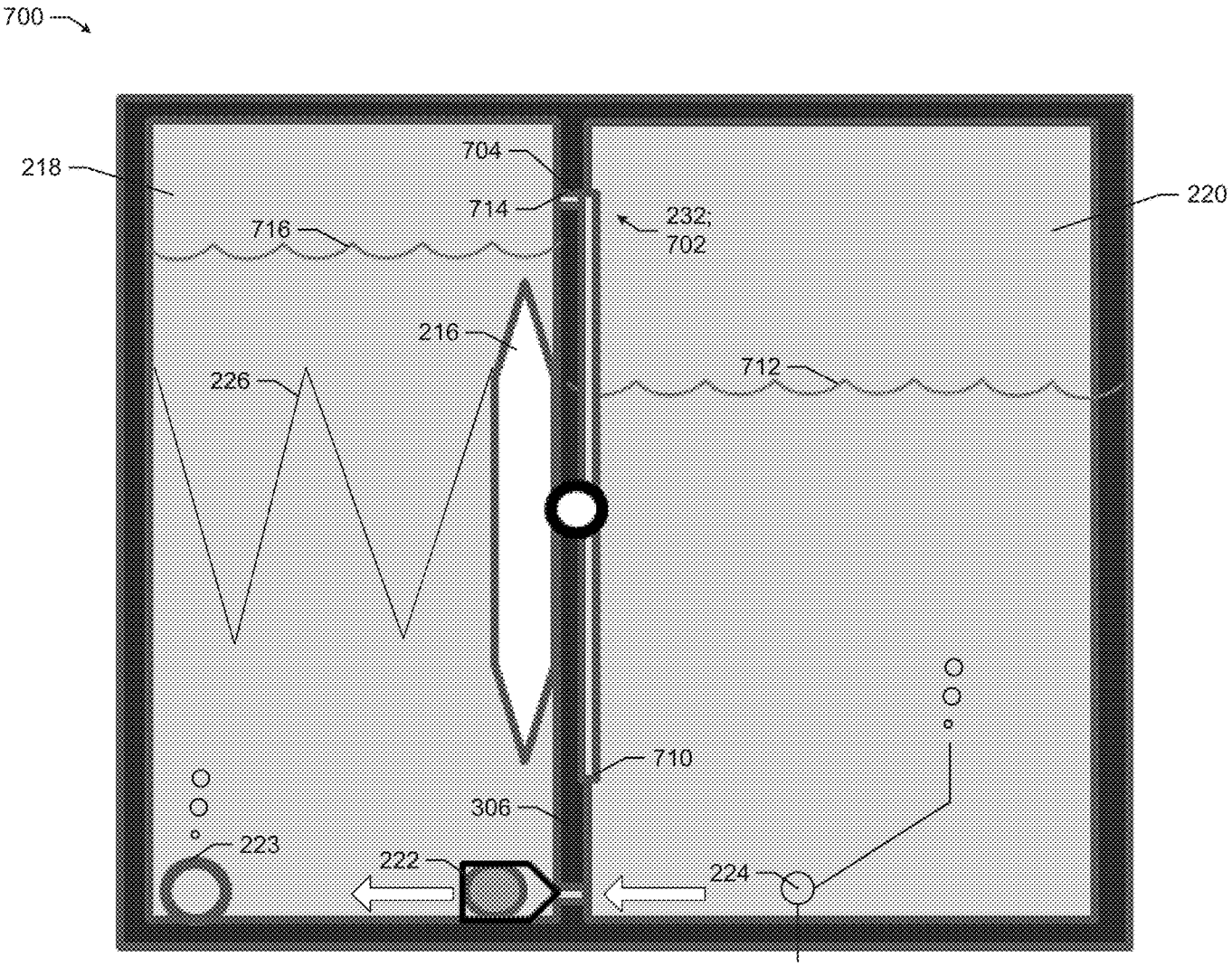
Figure 9:
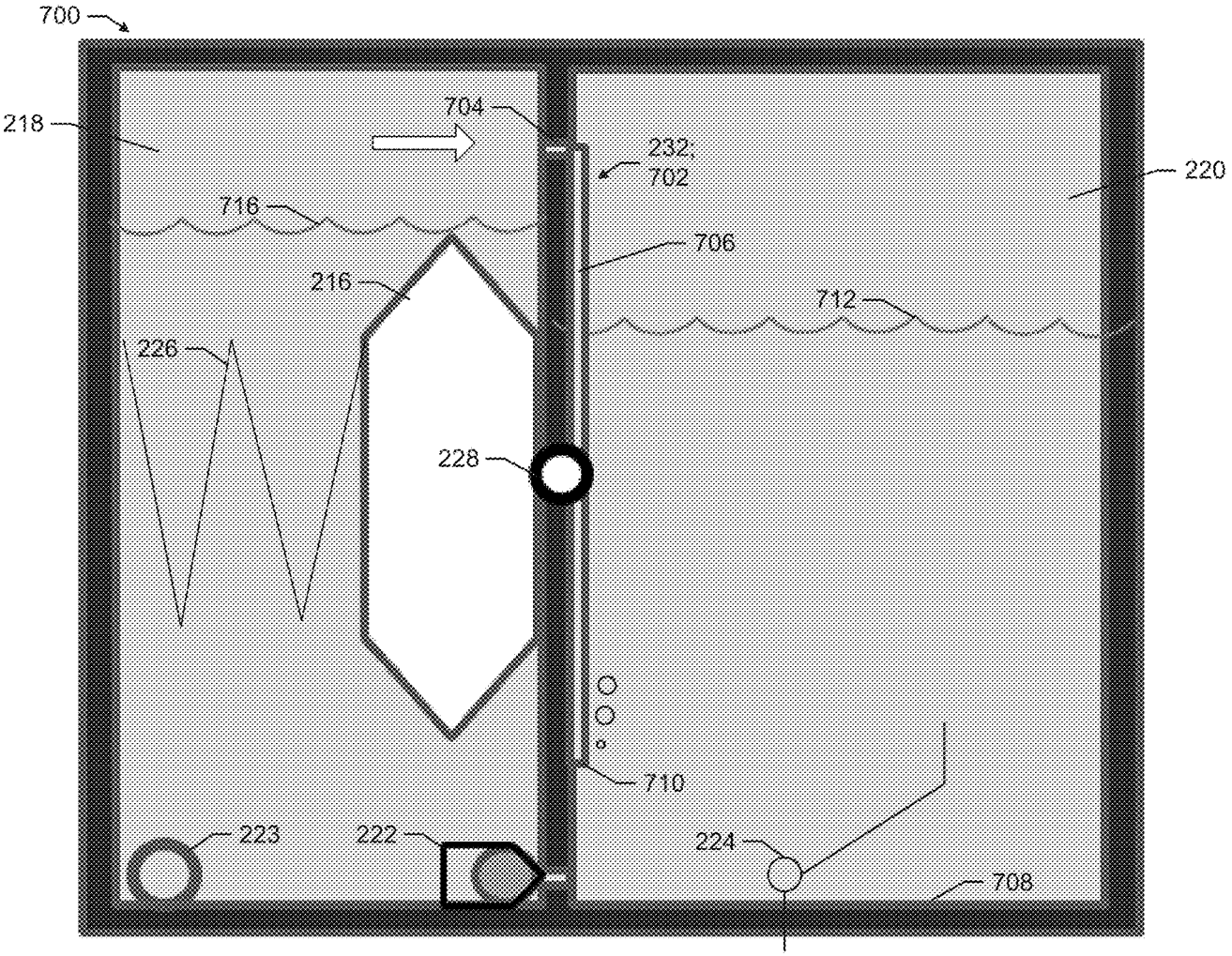

FIGS. 7, 8 and 9 illustrate an example ink supply 700 that can be used to implement the example ink supply 202 of FIG. 2. In this example, the regulator 232 is implemented as a one-way valve 702 that extends through an aperture 704 defined by the wall 306. In the illustrated example, the one-way valve 702 includes a flowline 706 that extends toward a surface 708 of the free-ink chamber 220 such that a first end 710 of the flowline 706 is disposed below an ink level 712 within the free-ink chamber 220 and a second end 714 of the flowline 706 is disposed above an ink level 716 within the regulated chamber 218.

As shown in FIG. 7, in some examples, to urge ink into the printer 200, the airbag 216 is inflated by the air pump 212 against a biasing force of a spring 226 to urge ink out of the regulator chamber 218 through the port 223. As shown in FIG. 8, in some examples, the airbag 216 is quickly deflated to draw air from the printer 200 into the regulated chamber 218 through the port 223.

As shown in FIG. 9, in some examples, when the pressure within the regulated chamber 218 increases above the threshold, a maintenance operation can be performed in which the airbag 216 is inflated against the spring force of the spring 226 and the first regulator 222 is in a closed position due to, for example, the increased pressure within the regulated chamber 218. When the pressure force is higher than the fluid force, fluid from the regulated chamber 218 flows out of the flowline 706 to the free-ink chamber 220 to vent air from the regulated chamber 218 into the free-ink chamber 220. When air is vented from the regulated chamber 218, the pressure within the regulated chamber 218 decreases.

As shown in FIG. 8, when the pressure within the regulated chamber 218 decreases below the threshold, the fluid force is greater than the pressure force, thereby substantially restricting further fluid flow between the regulated chamber 218 and the free-ink chamber 220. As set forth herein, substantially restricting means that the fluid flow (e.g., air flow) is reduced and/or discouraged by the interaction between the air and water pressure and/or that fluid (e.g., air) flow is prevented by the interaction between the air and water pressure. In some examples, the pressure in the regulated chamber 218 decreases when the airbag 216 is quickly deflated by the spring 226 after the valve 214 places the airbag 216 in fluid communication with ambient air.

Figure 10:
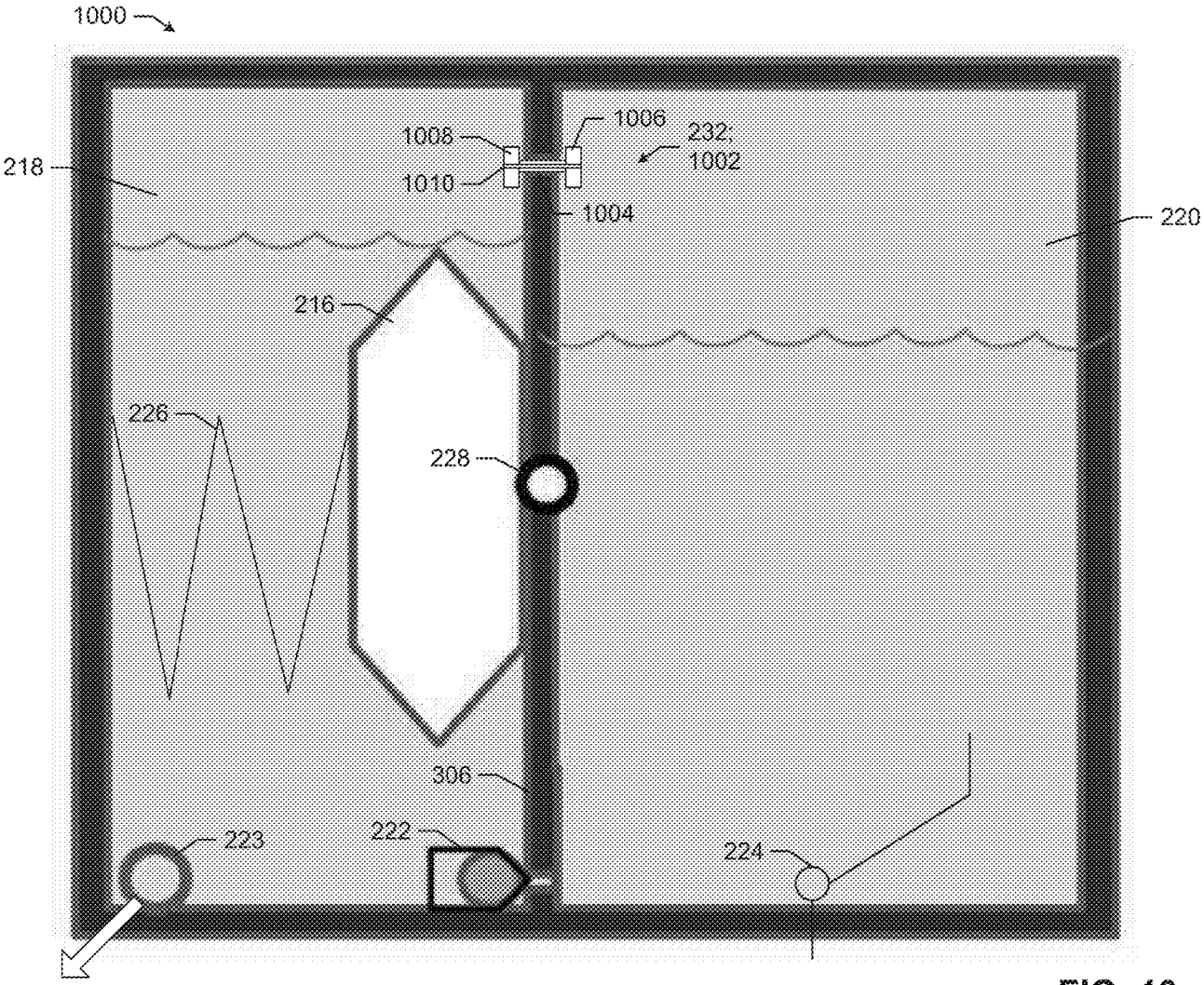
FIGS. 10, 11 and 12 are schematic illustrations of an example third ink supply that can be used to implement the example ink supply of FIG. 2 and/or the example printer of FIG. 1.
Figure 11:
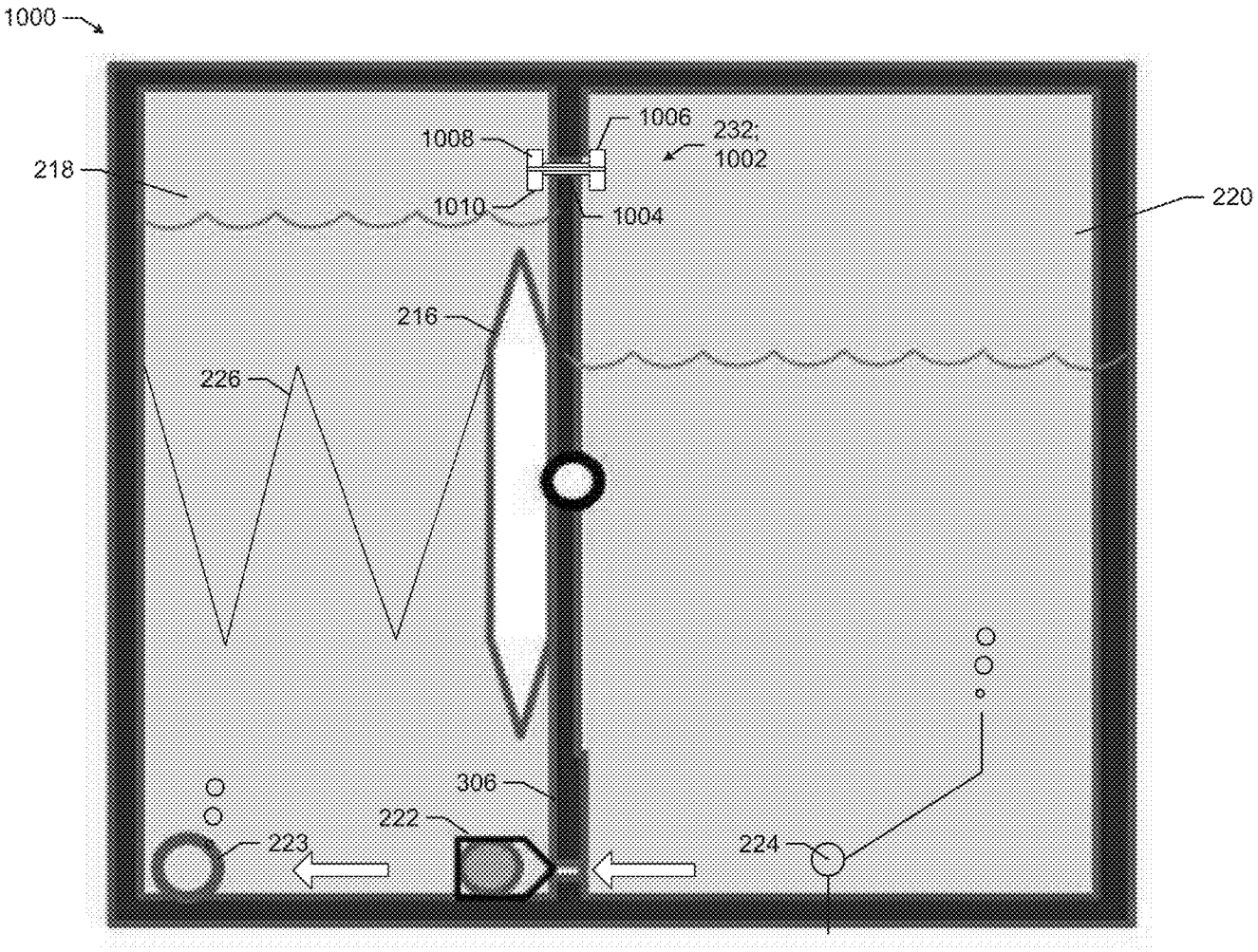
Figure 12:
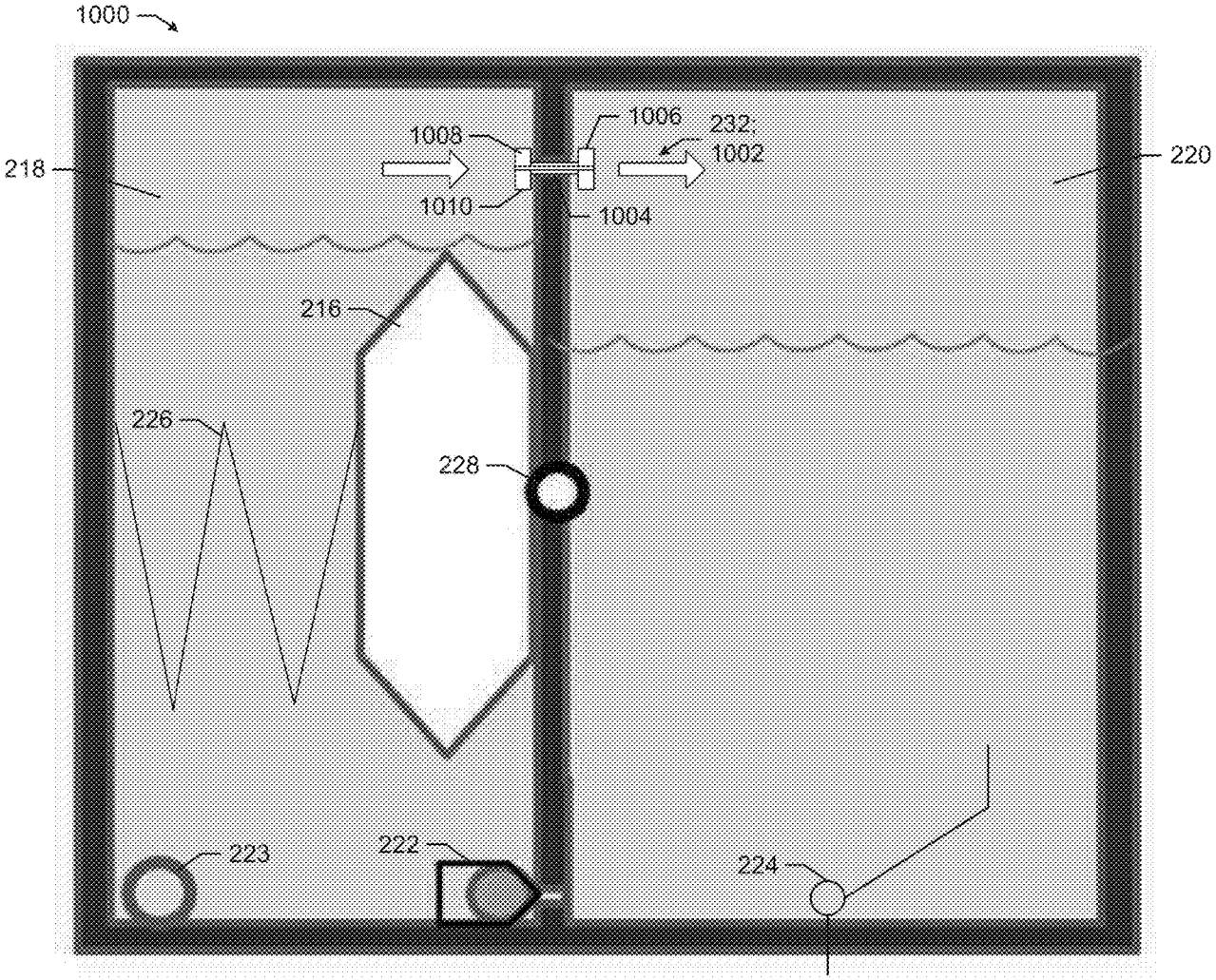

FIGS. 10, 11 and 12 illustrate an example ink supply 1000 that can be used to implement the example ink supply 202 of FIG. 2. In this example, the regulator 232 is implemented as an insert 1002 that extends through an aperture 1004 defined by the wall 306. The insert 1002 may be coupled within the aperture 1004 in any suitable way. For example, the insert 1002 may be coupled within the aperture 1004 using an interference fit and/or using any type of fastener (e.g., glue). In other examples, the regulator 232 may be implemented by the aperture 1004. In some such examples, the insert 1002 may not be provided.

In the illustrated example, the insert 1002 includes opposing flanges 1006, 1008 that are positioned on opposing sides of the wall 306 to secure the insert 1002 relative to the aperture 1004. The insert 1002 may be made of any suitable material, such as, for example, rubber, plastic, composite, etc. While in this example the insert 1002 includes two flanges, in other examples, the insert may include one or no flanges.

In some examples, the insert 1002 defines an aperture 1010 that facilitates fluid to flow between the regulated chamber 218 and the free-ink chamber 220. In some examples, the aperture 1010 is sized (e.g., the length of the aperture 1010, the diameter of the aperture 1010) to facilitate fluid to flow from the regulated chamber 218 to the free-ink chamber 220. In some examples, the aperture 1010 is sized to facilitate a first volume of fluid (e.g., ink) to flow from the free-ink chamber 220 to the regulated chamber 218 at a first rate and the aperture 1010 is sized to facilitate a second volume of fluid (e.g., air) to flow from the free-ink chamber 220 to the regulated chamber 218 at a second rate such that the first regulator 222 transfers more fluid from the free-ink chamber 220 to the regulated chamber 218 than the aperture 1010.

As shown in FIG. 10, in some examples, to urge ink into the printer 200, the airbag 216 is inflated by the air pump 212 against a biasing force of the spring 226 to urge ink out of the regulator chamber 218 through the port 223. As shown in FIG. 11, in some examples, to draw air out of the printer 200, the airbag 216 is quickly deflated to draw air from the printer 200 into the regulated chamber 218 through the port 223.

As shown in FIG. 12, in some examples, when the pressure within the regulated chamber 218 increases above the threshold and/or when the reservoir 201 is full of ink, a maintenance operation can be performed in which the airbag 216 is inflated against the spring force of the spring 226 and the first regulator 222 is in a closed position due to, for example, the increased pressure within the regulated chamber 218. When the pressure force is higher than the fluid force, fluid from the regulated chamber 218 flows through the aperture 1010 to the free-ink chamber 220 to vent air from the regulated chamber 218 into the free-ink chamber 220. When air is vented from the regulated chamber 218, the pressure within the regulated chamber 218 decreases.

Figure 13:
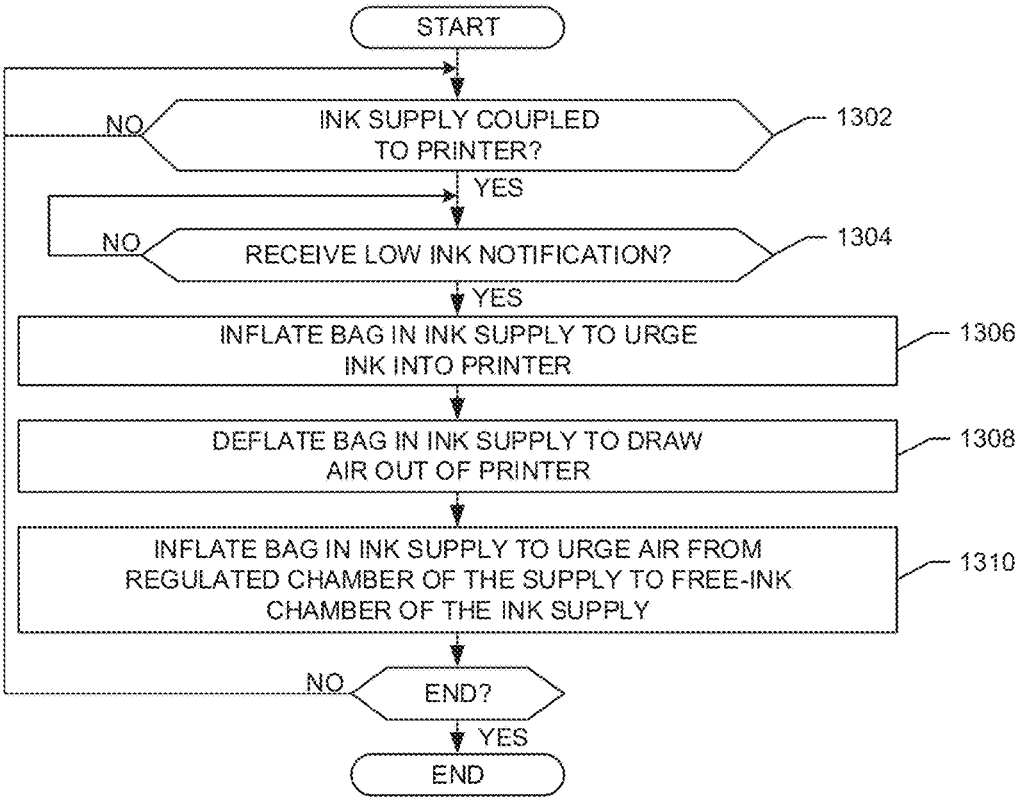
FIG. 13 is an example flowchart representative of example machine readable instructions that may be executed to the implement the example printer of FIGS. 1 and/or 2.
Figure 14:
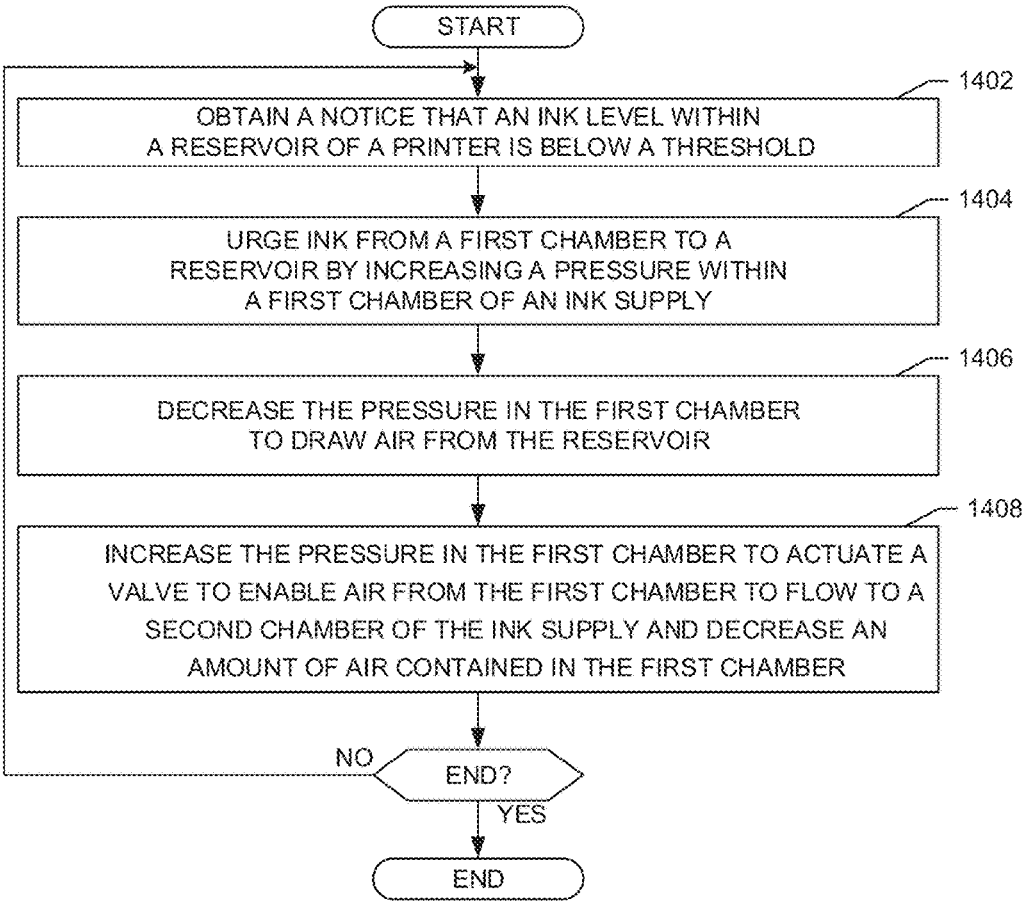
FIG. 14 is another example flowchart representative of example machine readable instructions that may be executed to the implement the example printer of FIGS. 1 and/or 2.

Flowcharts representative of example machine readable instructions for implementing the printer 100 FIG. 1 are shown in FIGS. 13 and 14. In this example, the machine readable instructions comprise a program for execution by a processor such as the processor 118 of FIG. 1 and/or the processor 1512 shown in the example processor platform 1500 discussed below in connection with FIG. 15. The program may be included in software stored on a tangible computer readable storage medium such as a CD-ROM, a floppy disk, a hard drive, a digital versatile disk (DVD), a Blu-ray disk, or a memory associated with the processor 118, 1512, but the entire program and/or parts thereof could alternatively be executed by a device other than the processor 118, 1512 and/or embodied in firmware or dedicated hardware. Further, although the example program is described with reference to the flowcharts illustrated in FIGS. 13 and 14, many other methods of implementing the example printer 100 may alternatively be used. For example, the order of execution of the blocks may be changed, and/or some of the blocks described may be changed, eliminated, or combined.

As mentioned above, the example processes of FIGS. 13 and 14 may be implemented using coded instructions (e.g., computer and/or machine readable instructions) stored on a tangible computer readable storage medium such as a hard disk drive, a flash memory, a read-only memory (ROM), a compact disk (CD), a digital versatile disk (DVD), a cache, a random-access memory (RAM) and/or any other storage device or storage disk in which information is stored for any duration (e.g., for extended time periods, permanently, for brief instances, for temporarily buffering, and/or for caching of the information). As used herein, the term tangible computer readable storage medium is expressly defined to include any type of computer readable storage device and/or storage disk and to exclude propagating signals. As used herein, "tangible computer readable storage medium" and "tangible machine readable storage medium" are used interchangeably. Additionally or alternatively, the example processes of FIGS. 13 and 14 may be implemented using coded instructions (e.g., computer and/or machine readable instructions) stored on a non-transitory computer and/or machine readable medium such as a hard disk drive, a flash memory, a read-only memory, a compact disk, a digital versatile disk, a cache, a random-access memory and/or any other storage device or storage disk in which information is stored for any duration (e.g., for extended time periods, permanently, for brief instances, for temporarily buffering, and/or for caching of the information). As used herein, the term non-transitory computer readable medium is expressly defined to include any type of computer readable device or disc and to exclude propagating signals. As used herein, when the phrase "at least" is used as the transition term in a preamble of a claim, it is open-ended in the same manner as the term "comprising" is open ended.

The program of FIG. 13 begins by determining whether or not an ink supply is coupled to a printer (block 1302) by, for example, the processor 118 obtaining a notice that the ink supply 115, 202, 300, 700, 1000 is coupled to the printer 100. The program of FIG. 13 then determines whether or not a low ink notification is received (block 1304) by, for example, the processor 118 obtaining a notice from the sensor 210 that an ink level within the reservoir 204 of the printer 100, 200 is below a threshold. If a low ink notice is received, in this example, an airbag is inflated in the ink supply to urge ink into the printer (block 1306) by, for example, the processor 118 actuating the valve 214 to fluidically couple the air pump 212 and the airbag 216 and causing the air pump 212 to inflate the airbag 216.

After the airbag is inflated, the airbag is deflated to draw air out of the printer (block 1308) by, for example, the processor 118 actuating the valve 214 to fluidically couple the airbag 216 to the atmosphere to facilitate a force of the spring 226 to overcome the pressure force within the airbag 216 to quickly deflate the airbag 216. To urge air out of the regulated chamber of the ink supply, the airbag is inflated to increase the pressure in the regulated chamber to cause a regulator to actuate (block 1310) by, for example, the processor 118 actuating the valve 214 to fluidically couple the air pump 212 and the airbag 216 and causing the air pump 212 to pump air into the airbag 216 to inflate the airbag 216, increase the pressure in the regulated chamber 218 and cause the regulator 232 to actuate to facilitate fluid to flow from the regulated chamber 218 to the free-ink chamber 220.

The program of FIG. 14 begins obtaining a notice that an ink level within a reservoir of a printer is below a threshold (block 1402) by, for example, the processor 118 obtaining a notice from the sensor 210 that an ink level within the reservoir 204 of the printer 100, 200 is below a threshold. Ink is then urged from a first chamber to the reservoir by increasing a pressure within a first chamber of an ink supply (block 1404) by, for example, the processor 118 actuating the valve 214 to fluidically couple the air pump 212 and the airbag 216 and causing the air pump 212 to inflate the airbag 216.

The pressure is decreased in the first chamber to draw air from the reservoir (block 1406) by, for example, the processor 118 actuating the valve 214 to fluidically couple the airbag 216 to the atmosphere to facilitate a force of the spring 226 to overcome the pressure force within the airbag 216 to quickly deflate the airbag 216. The pressure in the first chamber is increased to actuate a valve to facilitate air from the first chamber to flow to a second chamber of the ink supply and decrease an amount of air contained in the first chamber by, for example, the processor 118 actuating the valve 214 to fluidically couple the air pump 212 and the airbag 216 and causing the air pump 212 to pump air into the airbag 216 to inflate the airbag 216, increase the pressure in the regulated chamber 218 and cause the regulator 232 to actuate to facilitate fluid to flow from the regulated chamber 218 to the free-ink chamber 220.

Figure 15:
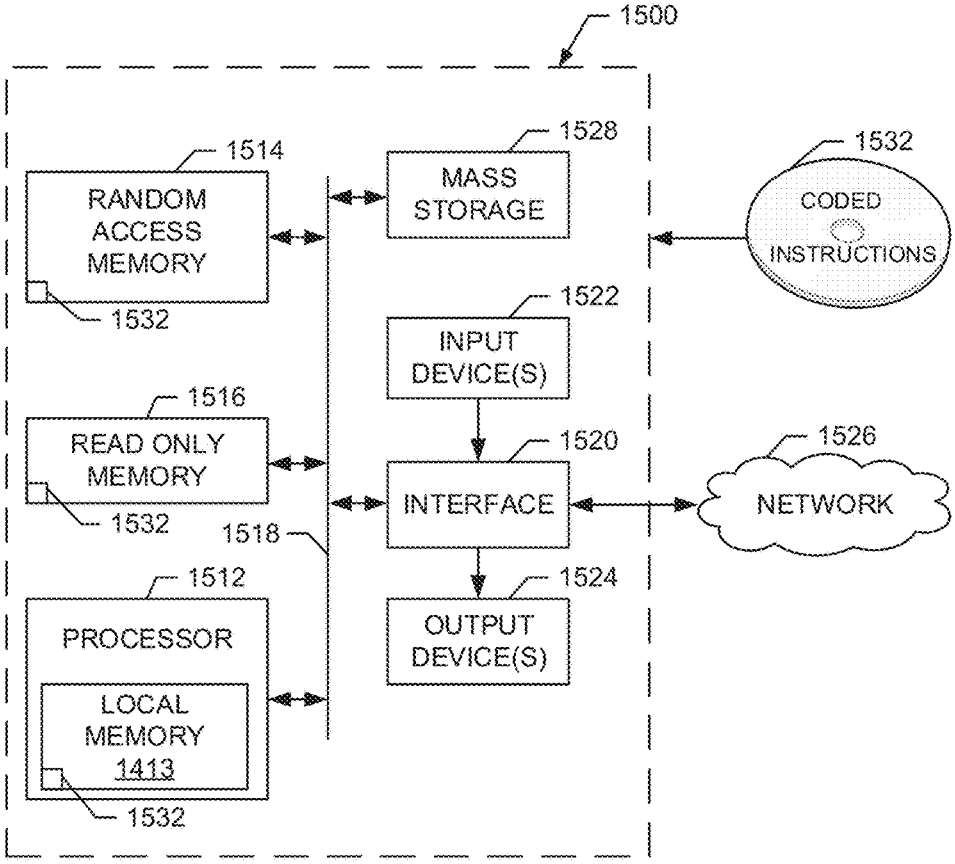
FIG. 15 is an example processor platform to execute the example instructions of FIGS. 13 and/or 14 to implement the printer of FIGS. 1 and/or 2.

FIG. 15 is a block diagram of an example processor platform 1500 capable of executing the instructions of FIGS. 13 and 14 to implement the printer 100, 200 and/or the ink supplies 202, 300, 700, 1000 of FIGS. 1-11. The processor platform 1500 can be, for example, a server, a personal computer, a mobile device (e.g., a cell phone, a smart phone, a tablet such as an iPad™), a personal digital assistant (PDA), an Internet appliance or any other type of computing device.

The processor platform 1500 of the illustrated example includes a processor 1512. The processor 1512 of the illustrated example is hardware. For example, the processor 1512 can be implemented by at least one of an integrated circuit, a logic circuit, a microprocessor or a controller from any desired family or manufacturer.

The processor 1512 of the illustrated example includes a local memory 1513 (e.g., a cache). The processor 1512 of the illustrated example is in communication with a main memory including a volatile memory 1514 and a non-volatile memory 1516 via a bus 1518. The volatile memory 1514 may be implemented by Synchronous Dynamic Random Access Memory (SDRAM), Dynamic Random Access Memory (DRAM), RAMBUS Dynamic Random Access Memory (RDRAM) and/or any other type of random access memory device. The non-volatile memory 1516 may be implemented by flash memory and/or any other desired type of memory device. Access to the main memory 1514, 1516 is controlled by a memory controller.

The processor platform 1500 of the illustrated example also includes an interface circuit 1520. The interface circuit 1520 may be implemented by any type of interface standard, such as an Ethernet interface, a universal serial bus (USB), and/or a PCI express interface.

In the illustrated example, at least one input device 1522 is connected to the interface circuit 1520. The input device(s) 1522 permit a user to enter data and commands into the processor 1512. The input device(s) can be implemented by, for example, an audio sensor, a microphone, a keyboard, a button, a mouse, a touchscreen, a track-pad, a trackball, isopoint and/or a voice recognition system.

At least one output device 1524 is also connected to the interface circuit 1520 of the illustrated example. The output devices 1524 can be implemented, for example, by display devices (e.g., a light emitting diode (LED), an organic light emitting diode (OLED), a liquid crystal display, a cathode ray tube display (CRT), a touchscreen, a tactile output device, a light emitting diode (LED), a printer). The interface circuit 1520 of the illustrated example, thus, typically includes a graphics driver card.

The interface circuit 1520 of the illustrated example also includes a communication device such as a transmitter, a receiver, a transceiver, a modem and/or network interface card to facilitate exchange of data with external machines (e.g., computing devices of any kind) via a network 1526 (e.g., an Ethernet connection, a digital subscriber line (DSL), a telephone line, coaxial cable, a cellular telephone system, etc.).

The processor platform 1500 of the illustrated example also includes at least one mass storage device 1528 for storing software and/or data. Examples of such mass storage devices 1528 include floppy disk drives, hard drive disks, compact disk drives, Blu-ray disk drives, RAID systems, and digital versatile disk (DVD) drives.

The coded instructions 1532 of FIGS. 13 and 14 may be stored in the mass storage device 1528, in the volatile memory 1514, in the non-volatile memory 1516, and/or on a removable tangible computer readable storage medium such as a CD or DVD.

From the foregoing, it will be appreciated that the above disclosed methods, apparatus and articles of manufacture relate to ink supplies and/or printers including such ink supplies. In some examples, the ink supplies are frozen and thawed during shipping. The freezing and/or thawing of the ink supplies may trap air within a regulated chamber of the ink supplies. If a threshold amount of air is received in the regulated chamber, the ink supplies may not be able to deliver ink to the printer even though ink remains in a free-ink chamber of the ink supplies.

To relieve pressure from the regulated chamber of the ink supplies disclosed herein, in some examples, a valve is disposed between the regulated chamber and the free-ink chamber. In some examples, the valve may be configured to actuate and/or enable fluid (e.g., air) to flow from the regulated chamber to the free-ink chamber when a pressure within the regulated chamber reaches a threshold. In some examples, the pressure within the regulated chamber reaches the threshold during a maintenance operation in which an airbag is inflated within the regulated chamber to urge ink into the printer and/or to urge air from the regulated chamber to the free-ink chamber. The valve may be disposed in any suitable position between the regulated chamber and the free-ink chamber. However, in some examples, the valve is disposed toward the top of a wall separating the regulated and free-ink chambers to enable air in the regulated chamber above an ink level to escape through the valve. The valve may be any suitable valve. However, in some examples, the valve is a pressure-activated cross-chamber one-way check valve, a regulator, a pressure relief valve, an umbrella valve, a flapper valve, a miniaturized solenoid valve (e.g., a fim valve), a duckbill valve, a vent valve, a mechanically and/or electrically actuatable valve, a passive regulator, a passive valve, a snorkel one-way valve, etc.

Using the examples disclosed herein, a shelf life of the example printer and/or the example ink supplies may be increased because built-up air is purgable from the regulated chamber. In some examples, the examples disclosed herein may increase an ability of an ink supply to draw and/or receive substantial amounts of air from the printer at startup (e.g., increase tolerance to startup air ingestion). The examples disclosed herein may increase longevity in low-use printers and/or ink supplies, enable an additional ink reservoir(s) to be included with a printer, increase capacity to pull above-filter air accumulation out of a printer and/or ink supply, increase the overall life of the printer and/or ink supplies, increase the performance of the printer and/or ink supplies, decrease warranty costs and/or improve customer satisfaction.

As set forth herein, an example apparatus includes a housing including a first chamber and a second chamber, the housing defining a first port to enable the first chamber to be fluidically coupled to a printer, the housing including a second port to fluidically couple the first chamber and the second chamber to enable fluid to flow from the second chamber to the first chamber; and a regulator coupled between the first chamber and the second chamber, the regulator to enable gas to flow from the first chamber to the second chamber when a pressure within the first chamber reaches a threshold.

In some examples, the apparatus includes a bladder disposed in the first chamber, the bladder being inflatable to increase the pressure within the first chamber. In some examples, the apparatus includes a spring to bias the bladder to a deflated position. In some examples, the regulator is a first regulator, further including a second regulator disposed in the second port. In some examples, the second regulator is a check valve. In some examples, the regulator is a first regulator and the apparatus includes a third port defined by the housing to couple the second chamber to an ambient pressure, a second regulator coupled to the second port. In some examples, the regulator is an umbrella valve. In some examples, the regulator includes a flowline to extend from a third port into the second chamber, the third port to fluidically couple the first chamber and the second chamber to enable fluid to flow from the first chamber to the second chamber. In some examples, the first chamber is a regulated chamber and the second chamber is a free-ink chamber.

An example apparatus includes a printer; and an ink supply to be coupled to the printer, the ink supply includes a housing including a first chamber and a second chamber, the housing defining a first port to enable the first chamber to be fluidically coupled to the printer, the housing including a second port to fluidically couple the first chamber and the second chamber to enable fluid to flow from the second chamber to the first chamber; and a regulator coupled between the first chamber and the second chamber, the regulator to enable gas to flow from the first chamber to the second chamber when a pressure within the first chamber reaches a threshold.

In some examples, the regulator is an umbrella valve. In some examples, the regulator includes a flowline to extend from a third port into the second chamber, the third port to fluidically couple the first chamber and the second chamber to enable fluid to flow from the first chamber to the second chamber. In some examples, the apparatus includes a bladder disposed in the first chamber, the bladder being inflatable to increase the pressure within the first chamber. In some examples, the apparatus includes a spring to bias the bladder to a deflated position.

An example method includes obtaining a notice that an ink level within a reservoir of a printer is below a threshold; urging ink from the first chamber to the reservoir by increasing a pressure within a first chamber of an ink supply; decreasing the pressure in the first chamber to draw air from the reservoir; and increasing the pressure in the first chamber to actuate a valve to enable air from the first chamber to flow to a second chamber of the ink supply and decrease an amount of air contained in the first chamber.

Although certain example methods, apparatus and articles of manufacture have been described herein, the scope of coverage of this patent is not limited thereto. On the contrary, this patent covers all methods, apparatus and articles of manufacture fairly falling within the scope of the claims of this patent.

What is claimed is:

1. An apparatus, comprising:

a housing including a first chamber and a second chamber, the housing defining a first port to fluidly couple the first chamber to a printer, the housing including a second port to fluidly couple the first chamber and the second chamber to flow fluid from the second chamber to the first chamber; and a regulator coupled between the first chamber and the second chamber, the regulator to flow gas from the first chamber to the second chamber when a pressure within the first chamber reaches a threshold.

2. The apparatus of claim 1, further including a bladder disposed in the first chamber, the bladder being inflatable to increase the pressure within the first chamber.

3. The apparatus of claim 2, further including a spring to bias the bladder to a deflated position.

4. The apparatus of claim 1, wherein the regulator is a first regulator, further including a second regulator coupled to the second port.

5. The apparatus of claim 4, wherein the second regulator includes a check valve.

6. The apparatus of claim 1, wherein the regulator is a first regulator, further including a third port defined by the housing to couple the second chamber to an ambient pressure, a second regulator coupled to the second port.

7. The apparatus of claim 1, wherein the regulator includes at least one of an umbrella valve or an insert.

8. The apparatus of claim 1, wherein the regulator includes a flowline to extend from a third port into the second chamber, the third port to fluidly couple the first chamber and the second chamber to flow fluid from the first chamber to the second chamber.

9. The apparatus of claim 1, wherein the first chamber is a regulated chamber and the second chamber is a free-ink chamber.

10. An apparatus, comprising:

a printer; and an ink supply to be coupled to the printer, the ink supply including:

a housing including a first chamber and a second chamber, the housing defining a first port to fluidly couple the first chamber to the printer, the housing including a second port to fluidly couple the first chamber and the second chamber to flow fluid from the second chamber to the first chamber; and a regulator coupled between the first chamber and the second chamber, the regulator to flow gas from the first chamber to the second chamber when a pressure within the first chamber reaches a threshold.

11. The apparatus of claim 10, wherein the regulator is at least one of an umbrella valve or an insert.

12. The apparatus of claim 10, wherein the regulator includes a flowline to extend from a third port into the second chamber, the third port to fluidly couple the first chamber and the second chamber.

13. The apparatus of claim 10, further including a bladder disposed in the first chamber, the bladder being inflatable to increase the pressure within the first chamber.

14. The apparatus of claim 13, further including a spring to bias the bladder to a deflated position.

15. A method, comprising:

obtaining a notice that an ink level within a reservoir of a printer is below a threshold;

urging ink from a first chamber of an ink supply to the reservoir by increasing a pressure within the first chamber;

decreasing the pressure in the first chamber to draw air from the reservoir; and increasing the pressure in the first chamber to actuate a valve to flow air from the first chamber to a second chamber of the ink supply and decrease an amount of air contained in the first chamber.

16. The apparatus of claim 1, wherein the housing includes a wall separating the first chamber from the second chamber, the regulator to engage a first side and a second side of the wall.

* * * * *